US006758719B1

(12) United States Patent
Nava

(10) Patent No.: US 6,758,719 B1
(45) Date of Patent: Jul. 6, 2004

(54) RADIO CONTROLLED VEHICLE WITH A SYSTEM FOR SELECTIVELY LIFTING PORTIONS OF THE VEHICLE FRAME

(76) Inventor: Rudy Nava, 4307 S. Cricket Cir., Spring, TX (US) 77388

( * ) Notice: Subject to any disclaimer, the term of this patent is extended or adjusted under 35 U.S.C. 154(b) by 0 days.

(21) Appl. No.: 10/378,229

(22) Filed: Mar. 3, 2003

(51) Int. Cl.[7] ..... A63H 17/26; A63H 17/00
(52) U.S. Cl. ..... 446/466; 446/437; 446/456
(58) Field of Search ..... 446/437, 456, 446/462, 466, 469, 454, 465, 470, 471; 280/43.23

(56) References Cited

U.S. PATENT DOCUMENTS 3,120,398 A * 2/1964 Archibald ..... 180/199
3,623,562 A * 11/1971 Pitra ..... 180/200
4,596,534 A * 6/1986 Ishimoto ..... 446/466
4,666,420 A * 5/1987 Nagano ..... 446/443
4,696,655 A * 9/1987 D'Andrade et al. ..... 446/466
4,822,316 A * 4/1989 Shaffer et al. ..... 446/466
5,338,246 A * 8/1994 Suto ..... 446/466
5,527,059 A * 6/1996 Lee, Jr. ..... 446/466
5,785,576 A * 7/1998 Belton ..... 446/456
5,868,600 A * 2/1999 Watanabe ..... 446/460
6,036,575 A * 3/2000 Rehkemper et al. ..... 446/466
6,589,098 B2 * 7/2003 Lee et al. ..... 446/465
6,620,023 B2 * 9/2003 Yeung ..... 446/466

* cited by examiner

*Primary Examiner*—Jacob K. Ackun
*Assistant Examiner*—Faye Francis
(74) *Attorney, Agent, or Firm*—David Fink

(57) ABSTRACT

A radio controlled toy vehicle having a frame comprised of a first frame portion and a transmission assembly portion. The transmission assembly portion having two wheels connected to an axle to support the transmission assembly and an electric motor and gear system for moving the toy vehicle in a forward or reverse direction. The toy vehicle has a gear box with an electric motor a first and second rotatable cam. A rod connected to the transmission assembly and rotatably mounted on a pin and engaging a rod from on of the first rotatable cam to act as a cam follower moving the rod in an up and down direction when the first rotatable cam rotates thereby extending the transmission assembly. A second rod connected to a third wheel and engaging a rod located on the second rotatable cam distal to the wheel and acting as a cam follower wherein the rod moves in an up and down direction when the second rotatable cam rotates, thereby extending the wheel attached at the distal end of the rod. These motions cam simulate "lowrider" type motions on specially adapted vehicles.

8 Claims, 2 Drawing Sheets

RADIO CONTROLLED VEHICLE WITH A SYSTEM FOR SELECTIVELY LIFTING PORTIONS OF THE VEHICLE FRAME

CROSS-REFERENCE TO RELATED APPLICATIONS

Not Applicable

STATEMENT REGARDING FEDERALLY FUNDED RESEARCH OR DEVELOPMENT

Not Applicable

REFERENCE TO A MICROFICHE APPENDIX

Not Applicable

FIELD OF THE INVENTION

The present invention relates to radio controlled toy vehicles and more precisely to a radio controlled toy vehicle with a system for selectively extending the wheels to facilitate lifting portions of the vehicle frame.

BACKGROUND OF THE INVENTION

One of the many ways in which cars and trucks are customized by individuals includes the installation of hydraulic lift assemblies within the suspension systems provided on the vehicles for permitting the operator to alter the orientation of the vehicle relative to the wheels.

Typically, the hydraulic set up in one of these "lowrider" vehicles includes a hydraulic suspension system, hydraulic pumps, dumps and a power source for creating the various desired movements. For example, depending upon the particular hydraulic arrangement employed, the chassis may be moved relative to any or all of the wheels such that either the front or rear end of the vehicle, or both, may be raised from or lowered to the ground, and hopping, side-to-side, and "dancing" movements may be performed.

Although it is known in the prior art to construct scale models of low rider vehicles, and to customize these scale models by detailing them to appear similar to actual low riders, these models fail to provide actual simulation of low rider movements. Low rider movements may consist of full front end lifting or full rear end lifting or the lifting of both front and rear ends simultaneously. A low rider may also be able to move the vehicle in a forward or reverse direction while maintaining the lifted position. Preferably, repetitive lifting and releasing causes the vehicle to display a "hopping" or "dancing" motion.

Another popular motion for some low rider vehicles is called the "three wheel" motion. A "three wheel" motion is performed by extending a predetermined wheel which causes the portion of the vehicle body supported by the extended wheel to be lifted. The lifting in turn causes the side of the vehicle with the extended wheel to be lifted causing the opposite wheel on the same side of the vehicle to be lifted off the ground and leaving the vehicle supported by only three wheels. It is desirable to have the vehicle still maintain mobility while remaining in the "three wheel" position.

U.S. Pat. No. 5,334,077 by Baily granted on Aug. 2, 1994 has attempted to duplicate Lowrider movements. The Bailey design incorporates strings or other roll up members which are connected to the front and rear axles of a toy car. The axles are mounted in vertical slots allowing movement of the axle in a vertical direction. The strings are able to be rolled up by small electric motors which have pulleys mounted on their shafts. When power is provided to the motor the pulley winds up the string and causes tension on the string which in turn creates a lifting action to the front or rear axle. Although this method of raising and lowering the vehicle with respect to the wheels does provide an effect, it cannot simulate a three wheel motion, nor can it simulate hopping.

U.S. Pat. No. 5,527,059 discloses a suspension system for toy models to mimic in a stationary position real world effects such as acceleration, cornering and the like. The suspension system discloses a motor connected to each of the vehicles wheels and a suspension arm fixed to the output shaft of a reduction gear set for each motor. The suspension arm can be pivotally driven or angularly displaced which allows for each of the wheels to be raised or lowered relative to the vehicle body. The '059 Patent does not disclose radio control, nor is the model independently mobile. Furthermore, a "hopping" motion could not be performed.

U.S. Pat. No. 5,785,576 entitled Radio Controlled Vehicle with Selectable Vehicle Suspension System, discloses a toy wheeled vehicle having a chassis and a selectable vehicle suspension system, with the vehicle having a frame and a chassis attached to the frame. The '576 Patent discloses a least one lifting motor mounted on the frame with a rotatable arm connected to a vertically extendable guidepost that is vertically extendable through the chassis opening and being connected to the chassis. Lowrider motions are simulated by extending the guideposts to lift the chassis. A three wheel motion could not be performed by the vehicle disclosed in the '576 Patent.

U.S. Pat. No. 5,722,872 entitled Counter Balanced Lift Assembly for Low-Rider Model Vehicles, discloses a radio controlled scale model of a vehicle that simulates some Lowrider motions. A solenoid is used to simulate a "hopping" effect in the front of the vehicle. A three wheel motion cannot be performed and motions cannot be sustained for viewing.

BRIEF SUMMARY OF THE INVENTION

A radio controlled toy vehicle, comprising a frame having longitudinal axes and comprised of a first frame portion and a transmission assembly portion. The transmission assembly portion having first and second wheels connected to an axle to support the transmission assembly. The transmission assembly further having a first electric motor and a gear system for transferring the rotational output of the first electric motor to the rear axle thereby rotating the first and second wheels in a predetermined direction. The toy vehicle having a gear box with a system of gear-wheels that accept a rotational output of a second electric motor and transfers the rotational output to a first rotatable cam when the second electric motor rotates in a clockwise direction and transfers the rotational output to a second rotatable cam when the second electric motor rotates in a counter-clockwise direction. The first rotatable cam has a first rod extending out generally perpendicular to a surface of the first cam and the second rotatable cam has a second rod extending out generally perpendicular to a surface of the second cam. The toy vehicle further comprising a third rod connected to the transmission assembly and rotationally mounted on a first pin on the first frame portion, thereby enabling the third rod to move rotationally with respect to the first frame portion. The third rod is dimensioned to engage the second rod as a cam follower so that the rotation of the second rotatable cam which moves the second rod around a circular path causes the third rod to move up and down in response to the position of the second rod. The toy vehicle also has a fourth rod having a third wheel mounted on an end. The fourth rod is rotationally mounted on a second pin on the first frame portion, thereby enabling the fourth rod to move rotationally with respect to the first frame portion. The fourth rod is dimensioned to engage the first rod on an end distal with respect to the third wheel as a cam follower, so that the rotation of the first rotatable cam which moves the first rod around a circular path causes the fourth rod to move up and down in response to the position of the first rod. The toy vehicle further has a fifth rod having a fourth wheel mounted on an end. The fifth rod is rotationally mounted on a third pin on the first frame portion, thereby enabling the fifth rod to move rotationally with respect to the first frame portion. The toy vehicle has a receiver for receiving radio signals and an electrical power source electrically connected to the receiver. The receiver is electrically connected to the electrical power inputs of the first and second electric motors and is operable for selectively supplying electrical power to the first and second electric motors in response to receiving a predetermined respective radio signal. Wherein, the vehicle may be moved by the transmission assembly in a forward or reverse direction relative to the longitudinal axes in response to a respective predetermined radio signal. In addition the third wheel may be selectively extended to engage a surface by the upward movement of the third rod and thereby cause the first frame portion to move in a direction away from the surface. Furthermore, the transmission assembly may be selectively extended to engage the surface by the upward movement of the fourth rod and thereby cause the first frame portion to move in a direction away from the surface.

In another embodiment according to the invention the toy vehicle has a plastic shell that is removably attached and used for changing or enhancing the appearance of the toy vehicle.

In yet another embodiment of the toy vehicle according to the invention, a four channel radio receiver is used to receive radio signals to control the movement of the toy vehicle.

In yet another embodiment according to the invention, a remote controlled toy vehicle comprising a frame having a longitudinal axes and comprised of a first frame portion and a rear assembly portion. The rear assembly portion having first and second wheels connected to an axle to support the rear assembly. The toy vehicle further comprising a gear box having a system of gear-wheels that accept a rotational output of a first electric motor and transfers the rotational output to a first rotatable cam when the first electric motor rotates in a clockwise direction and transfers the rotational output to a second rotatable cam when the first electric motor rotates in a counter-clockwise direction. The first rotatable cam has a first rod positioned off center to the first rotatable cam and extending out generally perpendicular to a surface of the first rotatable cam. The second rotatable cam has a second rod positioned off center to the second rotatable cam and extending out generally perpendicular to a surface of the second rotatable cam. The toy vehicle further comprising a third rod connected to the rear assembly and rotationally mounted on a first pin on the first frame portion thereby enabling the third rod to move rotationally with respect to said first frame portion. The third rod is dimensioned to engage the second rod as a cam follower so that the rotation of the second rotatable cam which moves the second rod around a circular path causes the third rod to move up and down in response to the position of the second rod. The toy vehicle has fourth rod having a third wheel mounted on an end. The fourth rod is rotationally mounted on a second pin on the first frame portion, thereby enabling the fourth rod to move rotationally with respect to the first frame portion. The fourth rod is dimensioned to engage the first rod on an end distal with respect to the third wheel as a cam follower so that the rotation of the first rotatable cam which moves the first rod around a circular path causes the fourth rod to move up and down in response to the position of the first rod. The toy vehicle has a fifth rod which has a fourth wheel mounted on an end. The fifth rod is rotationally mounted on a third pin on the first frame portion thereby enabling the fifth rod to move rotationally with respect to the first frame portion. The toy vehicle is further comprised of a receiver for receiving radio signals and an electrical power source that is electrically connected to the receiver. The receiver is electrically connected to the electrical power inputs of the first electric motor and operable for selectively supplying electrical power to the first electric motor in response to receiving a predetermined respective radio signal. Wherein the third wheel may be selectively extended to engage a surface by the upward movement of the third rod and thereby cause the first frame portion to move in a direction away from the surface and wherein the rear assembly may be selectively extended to engage the surface by the upward movement of the fourth rod and thereby cause the first frame portion to move in a direction away from the surface.

BRIEF DESCRIPTION OF THE DRAWING OF THE INVENTION

DETAILED DESCRIPTION OF THE INVENTION

Figure 1:
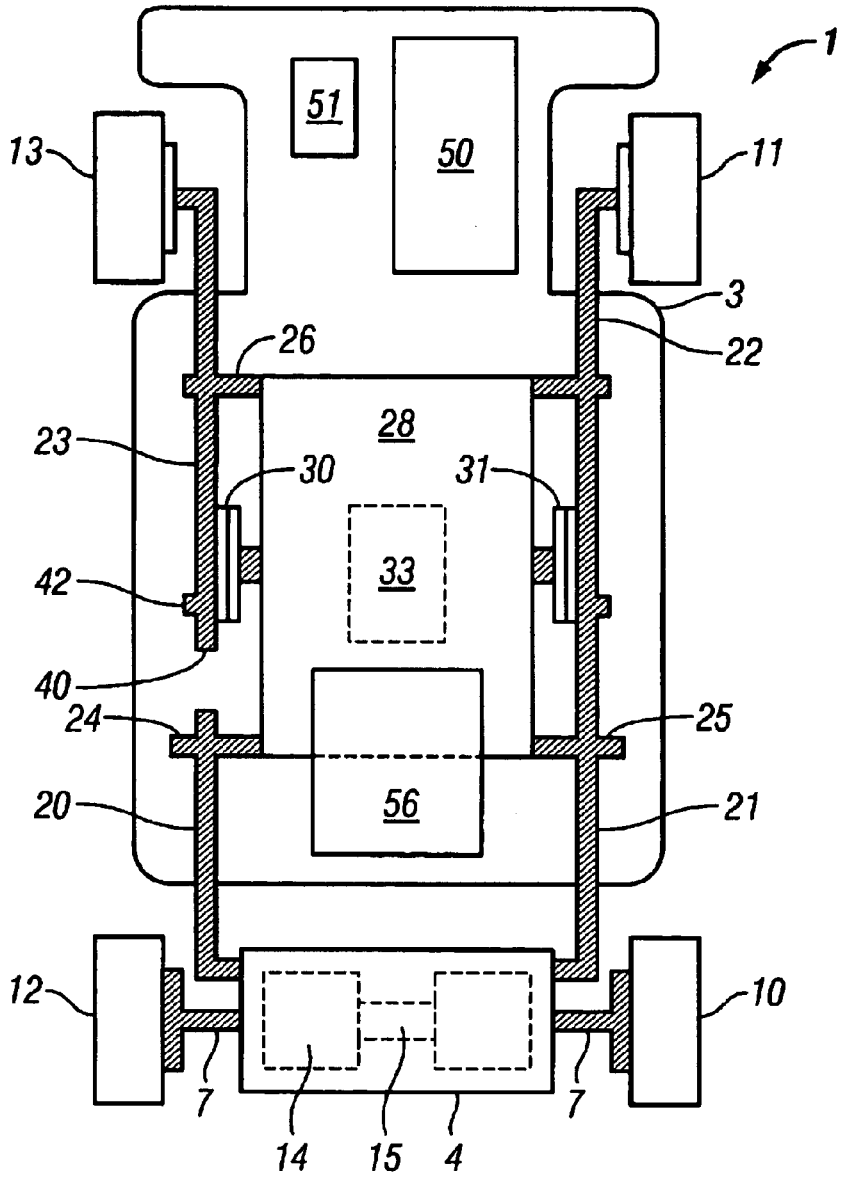
FIG. 1 is a top plan view of an embodiment of a radio controlled toy vehicle according to the invention with the outer shell defining the appearance of the vehicle removed.

Referring now to the drawings, a typical embodiment of the invention is shown in FIG. 1. Generally, vehicle 1 has a plastic shell (not shown) to define the appearance of the vehicle 1. Different plastic shells can be used to change the appearance of vehicle 1. It should be understood that this invention is not limited to a particular or specific description. Furthermore, the terminology used herein is for the purpose of describing particular embodiments only and is not intended to be limiting, as the scope of the present invention will be limited only be the appended claims.

The invention relates to a radio controlled toy vehicle that is able to simulate the motion of low rider vehicles equipped with hydraulic lifting mechanisms or the like. These vehicles are capable of causing the front or rear of the vehicle to be pushed upward and then released to bring the respective end to its normal position. When this activity is performed relatively rapidly, the motion and forces cause the vehicle to hop. In addition, the lifting forces may be concentrated on a portion of the car supported by one particular wheel thereby causing the vehicle to be supported by only three wheels.

Figure 2:
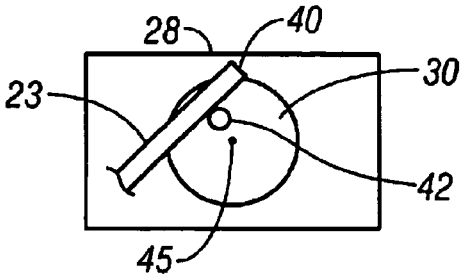
FIG. 2 is a side elevational view with portions removed of a rotatable cam and its interaction and positioning with respect to a rod according to the invention.
Figure 3:
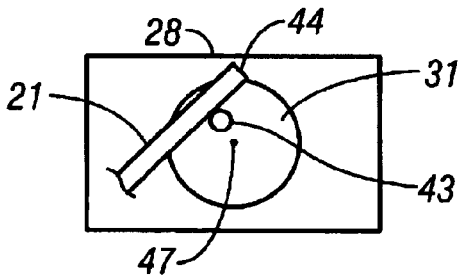
FIG. 3 is a side elevational view of the vehicle shown in FIG. 1 with portions removed of another rotatable cam and its interaction and positioning with respect to another rod according to the invention.
Figure 4:
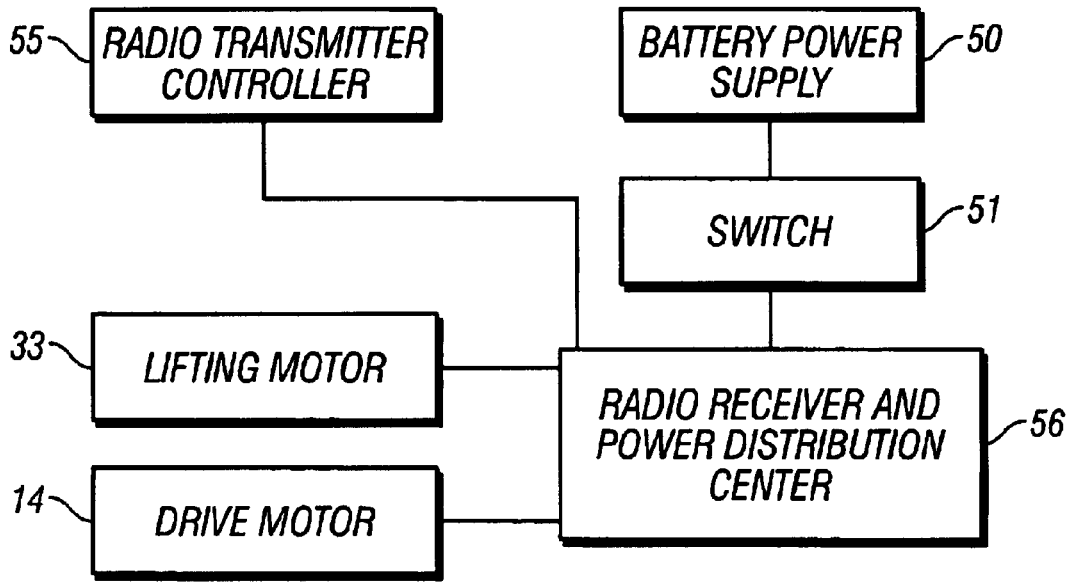
FIG. 4 is an electrical block diagram of the radio controlled vehicle shown in FIG. 1.
Figure 5:
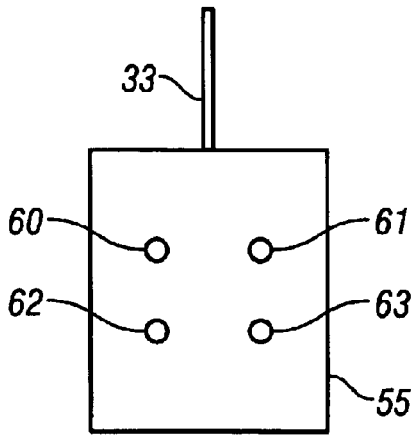
FIG. 5 is a top plan view of a radio transmitter device according to the invention.

As shown in FIGS. 1–5, in the present invention, a radio transmitter controller 55, shown in FIG. 5, known in the art, is capable of transmitting a radio signal on four different channels to be received by a radio receiver and power distribution center 56, shown in the block diagram in FIG. 4. A radio signal is transmitted on a predetermined channel by depressing either one of switches 60, 61, 62 or 63 on the controller 55. The radio signal transmitted by depressing switch 60 is received by radio receiver and power distribution center 56 and, by design, is interpreted to cause lifting electric motor 33 to produce a rotational output in a clockwise rotational direction. The radio signal transmitted by depressing switch 62 is received by radio receiver and power distribution center 56 and, by design, is interpreted to cause lifting electric motor 33 to produce a rotational output in a counter-clockwise rotational direction.

Likewise, the radio signal transmitted by depressing switch 61 is received by radio receiver and power distribution center 56 and, by design, is interpreted to cause drive motor 14 to produce a rotational output to cause axle 7 to turn in a clockwise rotational direction. The radio signal transmitted by depressing switch 63 is received by radio receiver and power distribution center 56 and, by design, is interpreted to cause drive motor 14 to produce a rotational output to cause axle 7 to turn in a counter-clockwise rotational direction.

FIG. 1 is a top plan view of an embodiment of a radio controlled toy vehicle 1 according to the invention. The toy vehicle 1 has a support frame 2 comprised of a front portion 3 and transmission assembly 4.

The support frame 2 of the vehicle 1 when placed on a surface is supported by wheels 10, 11, 12, and 13. Wheels 10 and 12 are connected to axle 7. Wheel 11 is connected to rod 22 and wheel 13 is connected to rod 23. Rods 22 and 23 are able to move independently with respect to each other and are rotatably movable relative to support frame 2.

Transmission assembly 4 has an axle 7 and wheels 10 and 12 connected to each end of axle 7. Wheels 10 and 12 are dependent upon axle 7 and rotate with the rotation of axle 7. Transmission assembly 4 has an electric motor 14 having a drive shaft 15 with a gear assembly 16 to transmit the rotation of shaft 15 to axle 7 and wheels 10 and 12.

Transmission assembly 4 is connected to front portion 3 by rods 20 and 21. Rod 20 is rotationally mounted on pin 24 which is connected to front portion 3 and allows rod 20 to move rotationally relative to front portion 3, thereby allowing transmission assembly 4 to move up and down relative to front portion 3. Rod 21 is rotationally mounted on pin 25 which is connected to front portion 3 and allows rod 21 to move rotationally with respect to front portion 3, thereby allowing transmission assembly 4 to move up and down relative to front portion 3.

Front portion 3 supports a gear box 28. Gear box 28 has two external rotatable cams 30 and 31 positioned on opposite sides of gear box 28. Gear box 28 has an electric lifting motor 33, which is known in the art, having a drive shaft, not shown, and a gear system, which is known in the art, that transmits the rotational output of the drive shaft of electric lifting motor 33 to rotatable cam 30 when the drive shaft of electric motor 33 is rotated in a clockwise direction and to rotatable cam 31 when the drive shaft of electric motor 33 is rotated in a counter-clockwise direction.

Rod 23 is rotationally mounted on pin 26 which is connected to front portion 3 and enables rod 23 to move rotationally with respect to front portion 3, thereby enabling wheel 13 to move up and down relative to front portion 3.

Rotatable cam 30, in the preferred embodiment, having a center point 45, is in the form of a disc with a single rod 42 which is off center and extending out generally perpendicular to the surface of the rotatable cam 30. Rod 23 is dimensioned so that end 40 of rod 23 engages rod 42. As shown in FIG. 2, Rod 23 engages rod 42 as a cam follower so that the rotation of rotatable cam 30 which moves rod 42 around a circular path results in rod 23 moving up and down in response to the position of rod 42.

Rotatable cam 31, in the preferred embodiment, having a center point 47, is in the form of a disc with a single rod 43 which is off center and extending out generally perpendicular to the surface of the rotatable cam 31. Rod 21 is dimensioned so that end 44 of rod 23 engages rod 43. As shown in FIG. 3, Rod 23 engages rod 43 as a cam follower so that the rotation of rotatable cam 31 which moves rod 43 around a circular path results in rod 21 moving up and down in response to the position of rod 42.

Referring to FIGS. 1–5, simulating motions of lowrider vehicles is performed by depressing radio buttons 60, 61, 62, and 63 on radio transmitter controller 55. A front hopping motion may be performed by depressing and holding radio button 60. When radio button 60 is depressed, radio controller 55 transmits a radio signal on a predetermined channel that is received by radio receiver and power distribution center 56. Radio receiver and power distribution center is electrically connected to lifting motor 33, as shown in FIG. 4, and causes lifting motor 33 to produce a rotational output in a clockwise rotational direction. The gear system in gear box 28 transmits the rotational output of electric lifting motor 33 to rotatable cam 30 causing rod 23 to move in an up and down direction relative to the front portion 3. As rod 23 is rotationally mounted on pin 26 the up and down movement of rod 23 causes the portion of the support frame 2 supported by wheel 13 to be lifted and lowered as rotatable cam 30 rotates. As rotatable cam 30 rotates rapidly, a front hopping motion is performed.

A rear hopping motion may be performed by depressing and holding radio button 62. When radio button 62 is depressed, radio controller 55 transmits a radio signal on a predetermined channel that is received by radio receiver and power distribution center 56. Radio receiver and power distribution center causes lifting motor 33 to produce a rotational output in a counter-clockwise rotational direction. The gear system in gear box 28 transmits the rotational output of electric lifting motor 33 to rotatable cam 31 causing rod 22 to move in an up and down direction relative to the front portion 3. As rod 22 is rotationally mounted on pin 26, the up and down movement of rod 22 causes the portion of the support frame 2 supported by transmission assembly 4 to be lifted and lowered as rotatable cam 31 rotates. As rotatable cam 31 rotates rapidly, a rear hopping motion is performed.

Toy vehicle 1 may be moved in a forward or reverse direction. When radio button 61 is depressed, radio controller 55 transmits a radio signal on a predetermined channel that is received by radio receiver and power distribution center 56. Radio receiver and power distribution center causes drive motor 14 to produce a rotational output in a counter-clockwise rotational direction causing axle 7 and wheels 10 and 12 to rotate in a clockwise direction, moving the vehicle in a forward direction. Likewise, when radio button 63 is depressed, radio controller 55 transmits a radio signal on a predetermined channel that is received by radio receiver and power distribution center 56. Radio receiver and power distribution center causes drive motor 14 to produce a rotational output in a clockwise rotational direction causing axle 7 and wheels 10 and 12 to rotate in a counter-clockwise direction, moving the vehicle in a reverse direction.

The radio buttons 60, 61, 62, and 63 may be used simultaneously to perform motions while the vehicle 1 is moving forward or reverse. For example, depressing and holding radio button 60 while depressing and holding radio button 61 causes the vehicle 1 to perform a front hopping motion while moving forward.

A three wheel motion is performed by depressing radio button 60 and releasing radio button 60 when the portion of support frame 2 supported by wheel 13 is in a lifted position. Because wheels 13 and 11 are independent of each other and wheels 12 and 10 are not independent of each other, wheel 12 is raised leaving only wheels 13, 11, and 10 supporting vehicle 1. Such a position is called a three wheel motion. Vehicle 1 may also be moved forward or in reverse while performing the three wheel motion. Other motions may be performed using the combinations of movements performed by depressing radio buttons 60, 61, 62, and 63.

A chassis from a model car or truck that conforms to the 25:1 or 24:1 ratio may be attached to the support frame 2. The chassis may be interchangeable by using a temporary attaching mechanism such as a hook and loop known as VELCRO (TRADEMARK). AMT and Revell or examples of companies that sell models having a chassis that conforms to the 25:1 or 24:1 ratio.

There has been described herein a novel system. It is evident that those skilled in the art may now make numerous uses and modifications of and departures from the specific embodiments described herein without departing from the inventive concepts. Consequently, the invention is to be construed as embracing each and every feature and novel combination of features present or possessed by the system herein disclosed and limited solely by the spirit and scope of the appended claims. Changes may be made in the various elements or assemblies or components described herein without departing from the spirit and the scope of the invention as defined in the following claims.

I claim:

1. A radio controlled toy vehicle, comprising:

a frame having a longitudinal axes and comprised of a first frame portion and a transmission assembly portion;

said transmission assembly portion having first and second wheels connected to a rear axle to support said transmission assembly; said transmission assembly further having a first electric motor and a gear system for transferring rotational output of said first electric motor to said rear axle thereby rotating said first and second wheels in a predetermined direction;

a gear box having a system of gear-wheels that accept a rotational output of a second electric motor and transfers said rotational output to a first rotatable cam when said second electric motor rotates in a clockwise direction and transfers said rotational output to a second rotatable cam when said second electric motor rotates in a counter-clockwise direction; said first rotatable cam having a first rod positioned off center to said first rotatable cam and extending out generally perpendicular to a surface of said first rotatable cam; said second rotatable cam having a second rod positioned off center to said second rotatable cam and extending out generally perpendicular to a surface of said second rotatable cam;

a third rod connected to the transmission assembly and rotationally mounted on a first pin on said first frame portion thereby enabling said third rod to move rotationally with respect to said first frame portion; said third rod dimensioned to engage said second rod as a follower so that the rotation of said second rotatable cam which moves said second rod around a circular path causes said third rod to move up and down in response to the position of said second rod;

a fourth rod having a third wheel mounted on an end; said fourth rod being rotationally mounted on a second pin on said first frame portion thereby enabling said fourth rod to move rotationally with respect to said first frame portion; said fourth rod dimensioned to engage said first rod on an end distal with respect to said third wheel as a follower so that the rotation of said first rotatable cam which moves said first rod around a circular path causes said fourth rod to move up and down in response to the position of said first rod;

a fifth rod having a fourth wheel mounted on an end; said fifth rod being rotationally mounted on a third pin on said first frame portion thereby enabling said fifth rod to move rotationally with respect to said first frame portion;

a receiver for receiving radio signals;

an electrical power source electrically connected to said receiver; said receiver being electrically connected to electrical power inputs of said first and second electric motors and operable for selectively supplying electrical power to said first and second electric motors in response to receiving a predetermined respective radio signal; and wherein, said vehicle may be moved by said transmission assembly in a forward or reverse direction relative to said longitudinal axes in response to a respective predetermined radio signal; and wherein said third wheel may be selectively extended to engage a surface by the upward movement of said third rod and thereby cause said first frame portion to move in a direction away from said surface; and wherein said transmission assembly may be selectively extended to engage said surface by the upward movement of said fourth rod and thereby cause said first frame portion to move in a direction away from said surface.

2. The radio controlled toy vehicle as claimed in claim 1, further comprising a means for removably attaching a plastic shell for changing the appearance of said vehicle.

3. The radio controlled toy vehicle as claimed in claim 1, wherein said receiver is a four channel radio receiver.

4. The radio controlled toy vehicle as claimed in claim 2, wherein said receiver is a four channel radio receiver.

5. A radio controlled toy vehicle, comprising:

a frame having a longitudinal axes and comprised of a first frame portion and a rear assembly portion;

said rear assembly portion having first and second wheels connected to an axle to support said rear assembly;

a gear box having a system of gear-wheels that accept a rotational output of a first electric motor and transfers said rotational output to a first rotatable cam when said first electric motor rotates in a clockwise direction and transfers said rotational output to a second rotatable cam when said first electric motor rotates in a counter-clockwise direction; said first rotatable cam having a first rod positioned off center to said first rotatable cam and extending out generally perpendicular to a surface of said first cam; said second rotatable cam having a second rod positioned off center to said second rotatable cam and extending out generally perpendicular to a surface of said second cam;

a third rod connected to the rear assembly and rotationally mounted on a first pin on said first frame portion thereby enabling said third rod to move rotationally with respect to said first frame portion; said third rod dimensioned to engage said second rod as a cam follower so that the rotation of said second rotatable cam which moves said second rod around a circular path causes said third rod to move up and down in response to the position of said second rod;

a fourth rod having a third wheel mounted on an end; said fourth rod being rotationally mounted on a second pin on said first frame portion thereby enabling said fourth rod to move rotationally with respect to said first frame portion; said fourth rod dimensioned to engage said first rod on an end distal with respect to said third wheel as a cam follower so that the rotation of said first rotatable cam which moves said first rod around a circular path causes said fourth rod to move up and down in response to the position of said first rod;

a fifth rod having a fourth wheel mounted on an end; said fifth rod being rotationally mounted on a third pin on said first frame portion thereby enabling said fifth rod to move rotationally with respect to said first frame portion;

a receiver for receiving radio signals;

an electrical power source electrically connected to said receiver; said receiver being electrically connected to electrical power inputs of said first electric motor and operable for selectively supplying electrical power to said first electric motor in response to receiving a predetermined respective radio signal;

wherein said third wheel may selectively extended to engage a surface by the upward movement of said third rod and thereby cause said first frame portion to move in a direction away from said surface; and wherein said rear assembly may be selectively extended to engage said surface by the upward movement of said fourth rod and thereby cause said first frame portion to move in a direction away from said surface.

6. The radio controlled toy vehicle as claimed in claim 5, further comprising a means for removably attaching a plastic shell for changing the appearance of said vehicle.

7. The radio controlled toy vehicle as claimed in claim 5, wherein said receiver is a two channel radio receiver.

8. The radio controlled toy vehicle as claimed in claim 6, wherein said receiver is a two channel radio receiver.

* * * * *